United States Patent [19]

Van Haaften

[11] 3,942,316

[45] Mar. 9, 1976

[54] SECTIONED CASING FOR ELECTRONIC WATCHES

[75] Inventor: Egbert Van Haaften, Closter, N.J.

[73] Assignee: Bulova Watch Company, Inc., New York, N.Y.

[22] Filed: Nov. 8, 1974

[21] Appl. No.: 522,271

[52] U.S. Cl. ..... 58/23 R; 58/88 R; 58/23 BA

[51] Int. Cl.[2] ..... G04C 3/00

[58] Field of Search ..... 58/88 R, 88 E, 88 G, 23 R, 58/23 BA, 50 R, 40 R; 317/120, 117; 224/4 R, 4 A, 4 B, 4 C, 4 D, 4 E, 4 F; D10/30, 32, 38, 39

[56] References Cited

UNITED STATES PATENTS

| | | | |
|---|---|---|---|
| 3,576,099 | 4/1971 | Walton | 58/23 R X |
| 3,784,725 | 1/1974 | Perkins et al. | 58/23 R X |
| 3,838,568 | 10/1974 | Zurcher et al. | 58/50 R X |

*Primary Examiner*—L. T. Hix
*Assistant Examiner*—U. Weldon

[57] ABSTRACT

A casing for an electronic watch whose movement is powered by one or more miniature battery cells. The casing has a generally rectangular form and a back opening surrounded by a flange. The casing is divided into two sections, one of which is occupied by the movement or electronic module and the other by the power cells. The back of the casing is enclosed by two adjoining hatch pieces, one covering the movement section and the other the power section. The opposing ends of the two hatch pieces are provided with lips which fit under the flange of the casing whereas the adjoining ends of the pieces have complementary grooves formed therein to define a bore for receiving a removable locking pin. The movement hatch piece is screwed to the casing and can only be taken off by a suitable tool, whereas the power hatch piece carries on its underside depressible contact springs which engage the poles of the cells seated in the power section of the casing whereby when the locking pin is removed, the released springs cause this hatch piece to jump up to expose the power section and permit replacement of the cells without disturbing the movement section.

5 Claims, 12 Drawing Figures

Fig. 1.
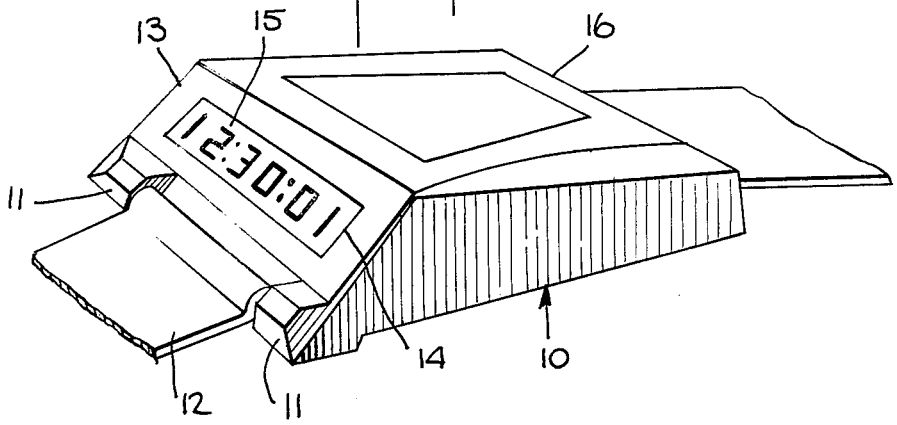
Fig. 2.
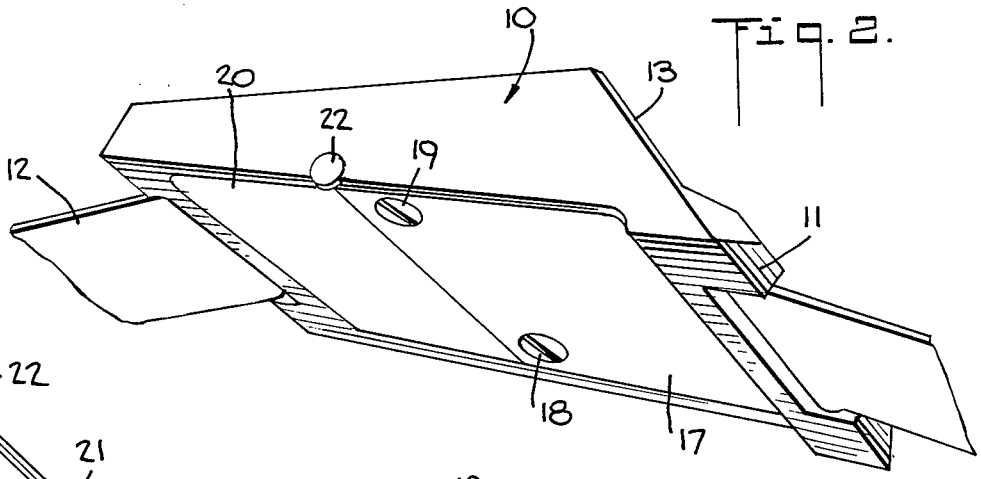
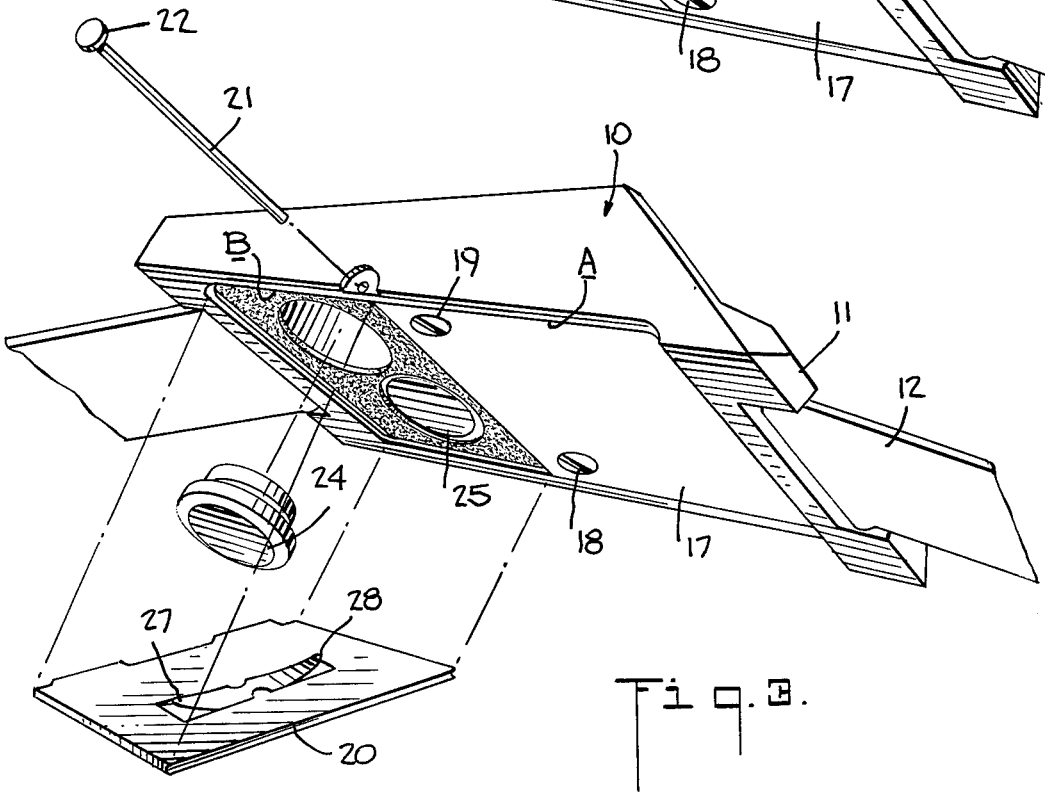
Fig. 3.

SECTIONED CASING FOR ELECTRONIC WATCHES

BACKGROUND OF THE INVENTION

This invention relates generally to casings for watches, and more particularly to a waterproof casing for a solid-state electronic watch, the casing having two distinct sections, one for the electronic module and the other for batteries to power the module.

The term solid-state electronic timepiece, as used herein, is limited to timepieces provided with an electro-optic time display and having no moving parts. The traditional, springpowered mechanical watch produces rotary motion for driving gear works that operate the moving hands or time indicators. In those electronic watches which also have a moving hand read-out, the oscillations of a balance wheel or the vibrations of a tuning fork are electronically-sustained, those oscillations or vibrations being converted into rotary motion for driving the gear train. Hence moving parts are included in electronic timepieces of this type.

However, in recently-introduced types of solid-state electronic watches such as those disclosed in U.S. Pat. Nos. 3,756,103 and 3,759,031 electrical pulses derived from a crystal-controlled time base serve to actuate a multi-digit electro-optic display formed either by light-emitting diodes (LED) or by liquid-crystal elements (LCD). Hence in such solid-state electronic timepieces, no moving parts are entailed. In such solid state watches, the high-frequency output of the time base is fed to a frequency converter constituted by a chain of integrated circuit divider stages. The output of the converter consisting of low-frequency timing pulses (i.e. 1 Hz), is applied to a display actuator in the form of a miniature time-computer module that counts the input pulse train, encodes it in binary form and then decodes and processes the results so as to provide the appropriate signals at the display stations.

Battery-operated electronic watches, whether of the type having moving parts or of the solid-state type, require one or more miniature battery cells to power the electronic movement. Because these cells have a limited life and must be replaced from time to time, the design of the watch casing is necessarily such as to provide access to the cell. In some electronic watch designs, the back of the casing is removable by means of a special tool to expose both the electronic movement and the battery cell. Since a special tool is entailed and care must be exercised, the cell cannot safely be replaced by the watch owner but only by a qualified watch repairman. There are several practical drawbacks to this arrangement, for the owner cannot himself immediately replace a dead battery but must find and pay for the services of a repairman. Also because the entire movement is exposed when the casing back is removed, a careless replacement of the battery may result in damage to the movement.

In order to avoid having to remove the entire casing back in order to replace a battery cell, it is known to provide backs with threaded, disc-shaped waterproof hatches which may be removed by the owner by means of a coin to provide access only to the battery cell. This has the advantage of permitting the owner to replace the cell without having to engage a repairman, but this design involves a more costly casing.

Where, in the case of existing types of solid-state watches, it is necessary to provide two battery cells to produce a voltage whose level is sufficient to power the LCD or LED display, it is not feasible to have a casing with two access hatches, one for each battery, nor is it desirable to have a casing whose back must be removed in order to replace the cells, for in doing so the delicate electronic movement is exposed and may be damaged.

It must be borne in mind that in a solid-state watch, the electronic circuits are embodied in an integrated circuit chip which is connected by fine leads to a display unit, connections also being made to various control switches. Thus an electronic assembly or module can only be safely handled by a specialist, and should the casing arrangement be such as to expose the movement each time as battery change is made, the likelihood of damage to the movement is increased.

SUMMARY OF THE INVENTION

In view of the foregoing, it is the main object of this invention to provide a casing for an electronic watch whose movement is powered by one or more battery cells, the casing being divided into two sections, one for the movement and the other for the cells, access to the power section being through a separate hatch piece whereby the cells may be replaced without disturbing the movement.

More particularly, it is an object of the invention to provide a casing of the above type, in which the hatch piece for the power section is locked by means of a pin which may be easily removed by the user without the need for a tool, the arrangement being such that when the pin is withdrawn, the power hatch piece springs open.

A significant feature of the invention is that both sections of the casing are water-proofed by a common panel of elastomeric material which underlies the hatch pieces and serves to blanket and protect the movement and the power cells.

Also an object of the invention is to provide a divided casing of the above type in which the movement section is isolated from the power section and in which the movement hatch piece is screwed in place, so that to obtain access thereto one must use a tool to remove the screws. Hence, while the user can readily remove the power hatch piece to replace batteries, the integrity of the delicate movement section is protected against careless mishandling.

Briefly stated, these objects are attained in a casing of generally rectangular form which is divided into two sections, one of which is occupied by the movement or electronic module of the solid-state watch, the other by one or more power cells. The back opening of the casing is surrounded by a flange and is closed by two adjoining hatch pieces, one covering the movement section and the other the power section. The opposing ends of the hatch pieces are provided with lips which fit under the flange, whereas the adjoining ends have complementary grooves formed therealong to define a split bore for receiving a removable locking pin which bridges the sides of the casing.

The movement hatch piece is screwed to the casing and can only be taken off by a tool, whereas the power hatch piece carries depressible contact springs on its underside which engage the poles of the cells seated in the power section whereby when the locking pin is removed, the released springs cause this piece to jump up to expose the power section and permit replacement of the cells without disturbing the movement section.

OUTLINE OF THE DRAWINGS

For a better understanding of the invention as well as other objects and further features thereof, reference is made to the following detailed description to be read in conjunction with the accompanying drawings, wherein:

FIG. 1 is a perspective view of one preferred embodiment of a solid-state watch casing in accordance with the invention, the casing being positioned relative to the viewer to present the time display;

FIG. 2 shows the back of the same casing;

FIG. 3 is the same as FIG. 2, but with the power section hatch piece removed to reveal the battery cells;

DESCRIPTION OF THE INVENTION

Figure 4:
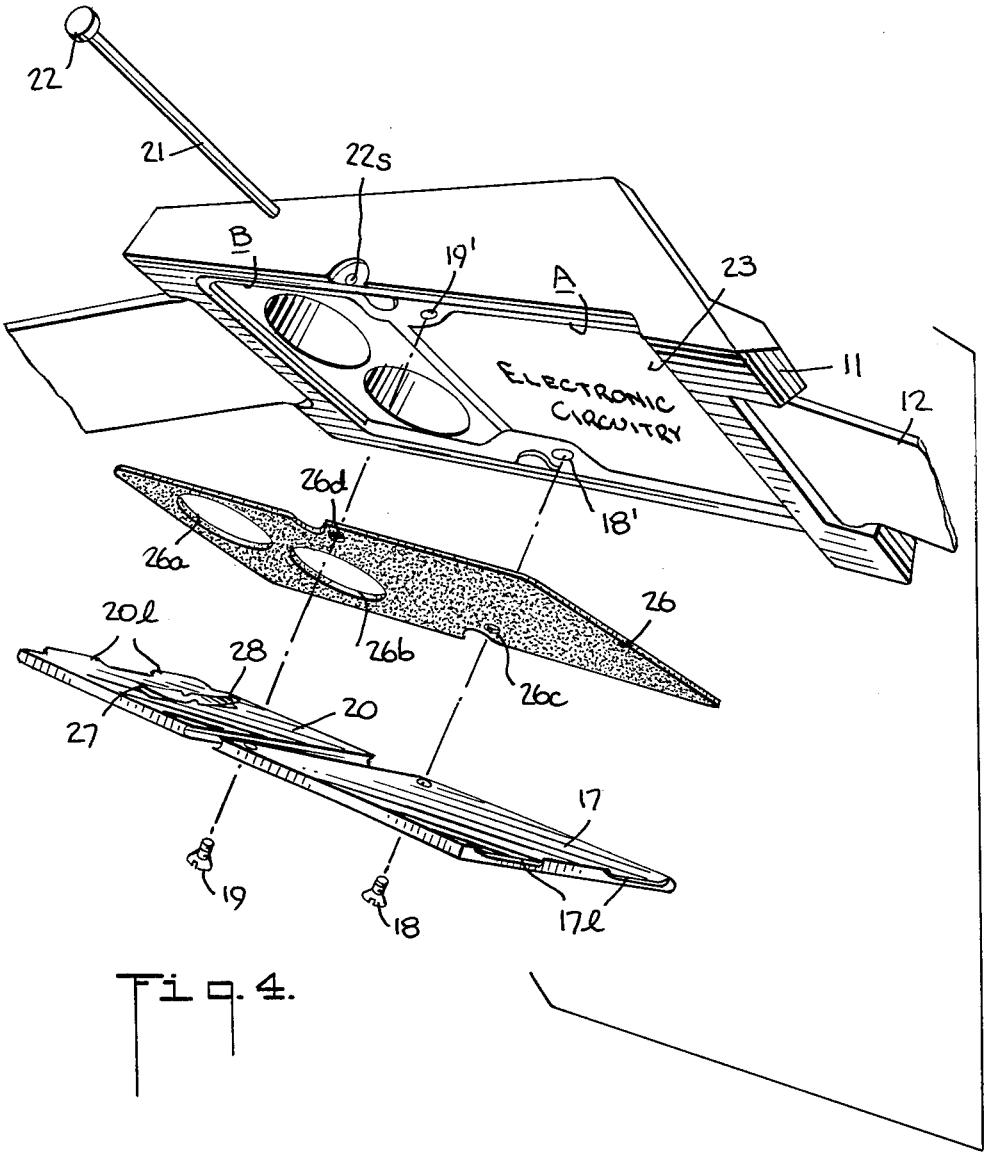
FIG. 4 is the same as FIG. 2 but with both the power section and the module section hatch pieces as well as the waterproofing panel removed to reveal the contents of the casing.
Figure 5:
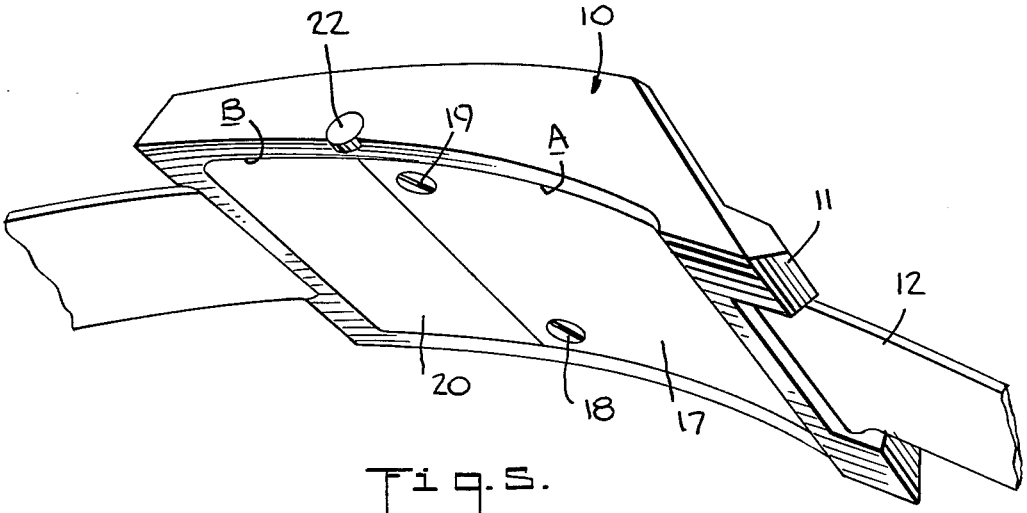
FIG. 5 is a perspective view, as seen from the rear of another preferred embodiment of a casing in accordance with the invention.

Referring now to FIG. 1, there is shown a partitioned watch casing 10 for a solid state watch, the casing having a generally rectangular configuration and being provided with end lugs 11 to which the straps 12 of a watch band are attachable in the usual manner by means of retractable pins.

The viewing end 13 of the casing is sloped, and formed therein is a rectangular window 14 behind which is disposed the digital elements of a display unit 15 which may be of the liquid crystal or light-emitting diode type. This display unit is integrated with the logic circuits and other electronic components of a solid state module housed in the module section of the casing. The top wall 16 of the casing is blank and may serve an ornamental purpose, for the user of the watch obtains time-related information from the sloped end display.

Referring now to FIGS. 2, 3 and 4 which show the back of the casing 10, it will be seen that the back is composed of a hatch piece 17 which is secured to the casing by screws 18 and 19, and a separate hatch piece 20 which is held in place by a removable pin 21 having a head 22. Hatch piece 17 covers a module section A which accommodates an electronic module 23, while hatch piece 20 covers a power section B having circular wells therein for receiving battery cells 24 and 25. Both sections of the casing are blanketed by a waterproofing panel 26 of silicone rubber or other elastomeric material. The panel is provided with two large circular openings 26*a* and 26*b* which register with the battery wells in the power section and two small holes 26*c* and 26*d* for admitting screws 18 and 19 into threaded bores 18′ and 19′ formed in the rear of the casing.

The inside face of the power hatch piece 20 has secured thereto a wing-shaped contact element defining depressible spring fingers 27 and 28. These fingers, when this hatch piece is in place, press against and electrically engage the end poles of battery cells 24 and 25 respectively, thereby connecting these poles to the casing which represents ground. The opposing poles of these cells engage contacts at the bottom of the battery wells, which contacts are connected to the electronic module. Thus the module is powered only when the hatch piece 20 is in place to complete the battery circuits.

Figure 6:
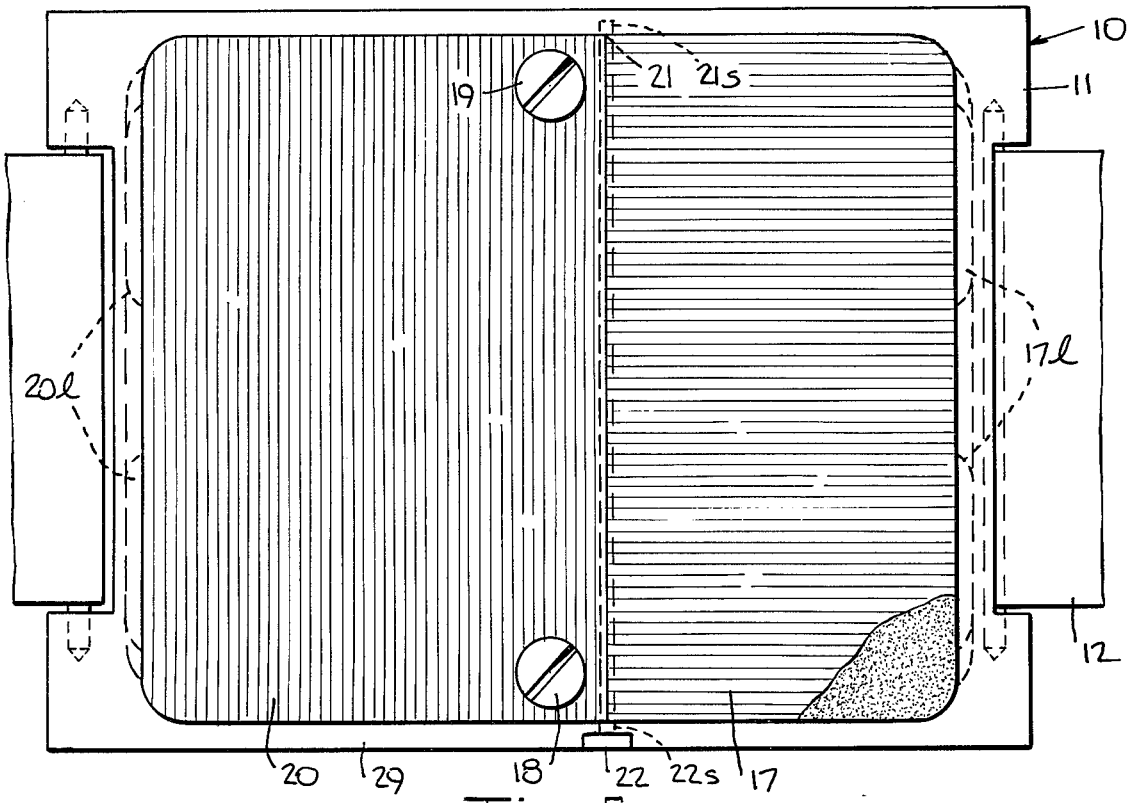
FIG. 6 is a rear plan view of the casing shown in FIG. 1, with both hatch pieces in place to close the casing back.
Figure 7:
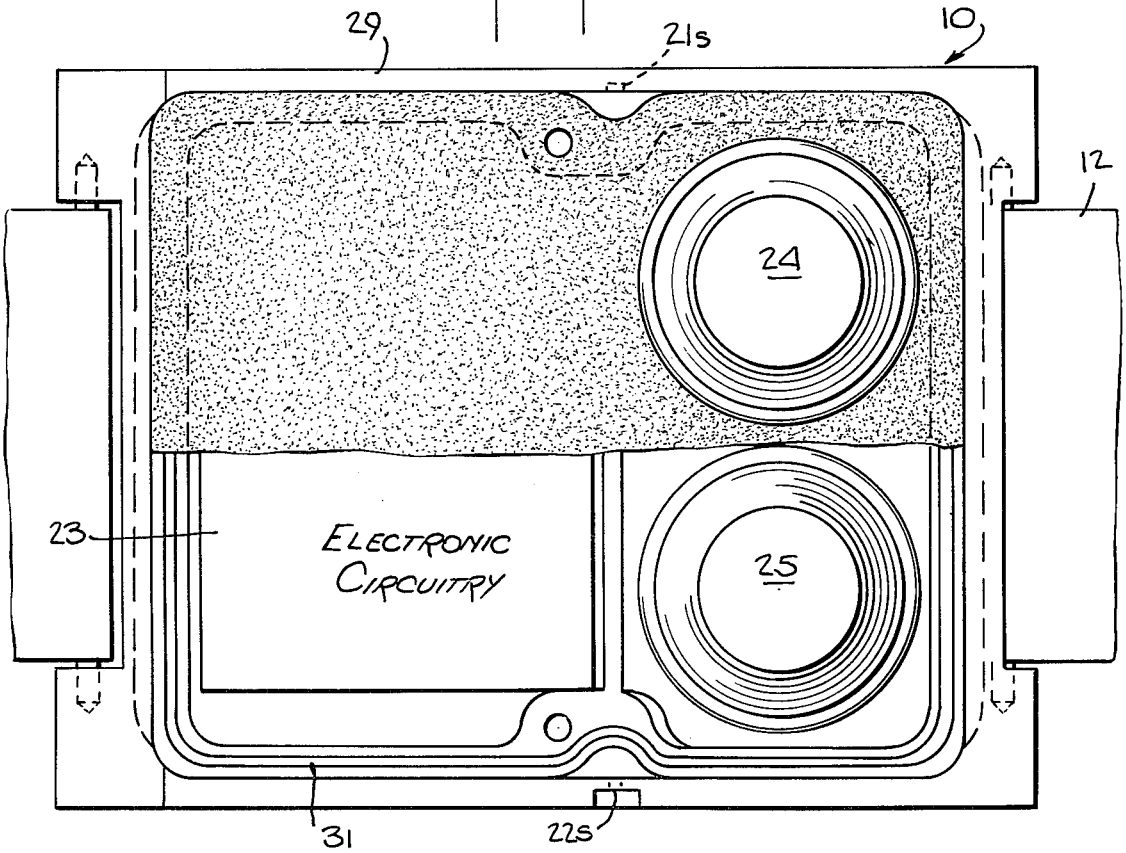
FIG. 7 is the same as FIG. 6 but with both hatch pieces removed and with the waterproofing panel cut away to expose the casing sections.
Figure 8:
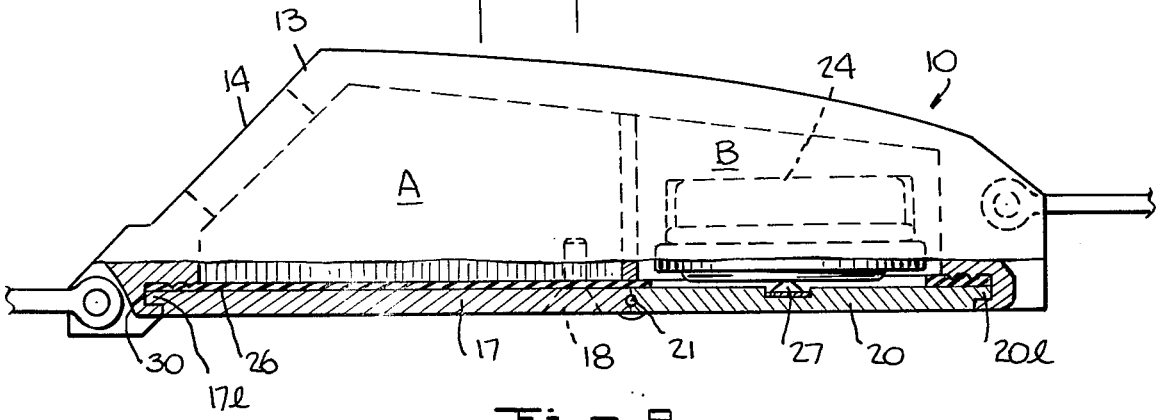
FIG. 8 is a longitudinal section taken through the casing shown in FIG. 1, with both hatch pieces in place.
Figure 9:
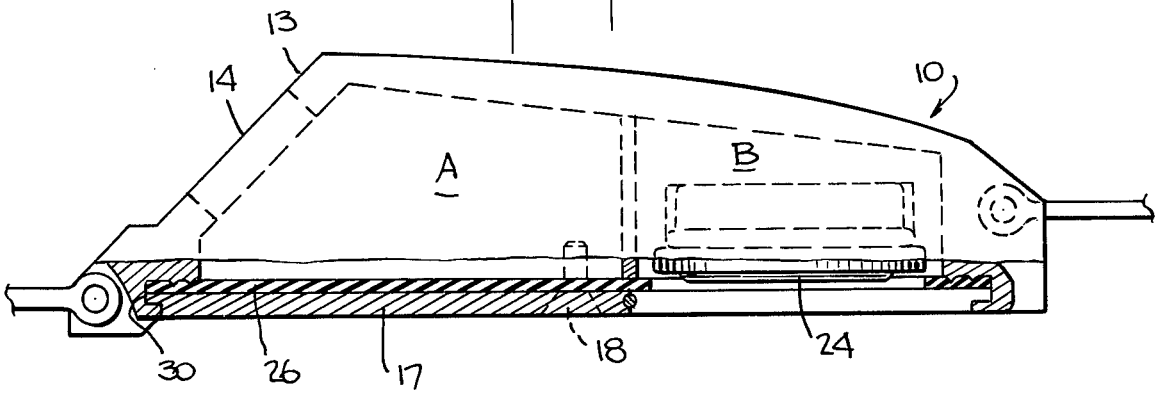
FIG. 9 is the same as FIG. 8 but with the power section hatch piece removed.
Figure 10:
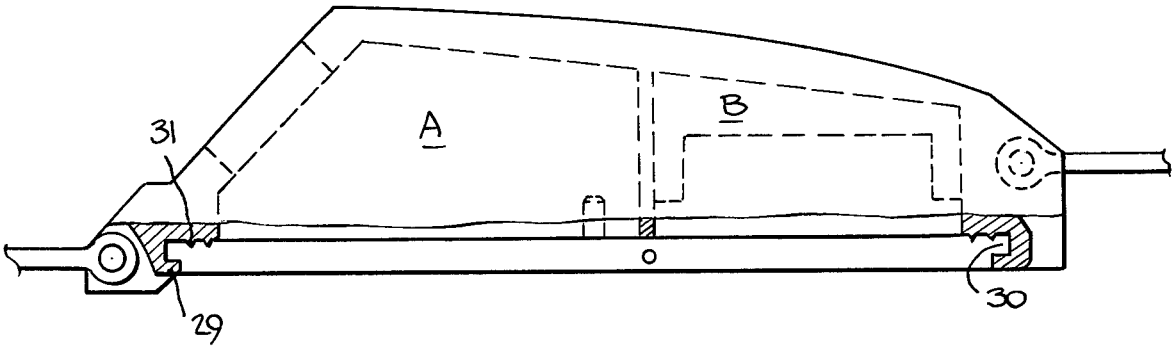
FIG. 10 is the same as FIG. 8 but with both the power and the module hatch pieces, as well as the waterproofing panel removed.

As best seen in FIGS. 6 and 7, the back opening of the casing is surrounded by a peripheral flange 29, the hatch pieces 17 and 20 fitting neatly into the flange. Underlying the flange is a recess 30 (see FIGS. 8, 9, 10 and 12) whose serrated edge 31 is engaged and gripped by the margins of the waterproofing panel 26 so that the panel is prevented from shifting, the serrations aiding in sealing the casing.

Figure 11:
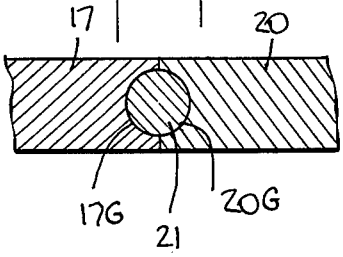
FIG. 11 is a detail showing the abutting ends of the two hatch pieces.
Figure 12:
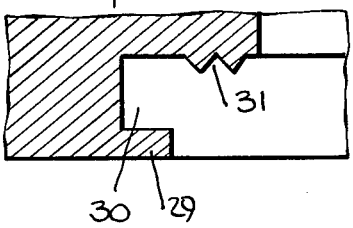
FIG. 12 is a detail showing the recess in the casing flange for receiving the lips of a hatch piece.

The opposite ends of hatch pieces 17 and 20 are provided with projecting lips 17 and 20, respectively, which are received within recess 30 thereby holding these ends of the hatch pieces in the back of the casing. The adjoining ends of the hatch pieces 17 and 20, as best seen in FIG. 11, have complementary grooves 17G and 20G formed therein to define a split bore to receive pin 21. As will be evident in FIG. 6, pin 21 when inserted in this bore, bridges the sides of the casing, the head 22 of the pin 21 lying within a socket 22s on one side of the casing and the top lying within a small socket 21s on the other side. In practice it is not necessary that the pin bridge the casing and in fact a holding action is obtainable with a shortened pin which does not reach the other side of the casing.

Thus when pin 21 is inserted, it locks in hatch piece 17. But when the pin is removed, hatch piece 17 is now free and the spring fingers 27 and 28 which had been pressed against the poles of the battery cells, are released, as a result of which hatch piece 17 is caused to jump up and expose the cells.

While there have been shown and described preferred embodiments of a sectioned casing for electronic watches in accordance with the invention, it will be appreciated that many changes and modifications may be made therein without, however, departing from the essential spirit thereof.

I claim:

1. A partitioned casing for a solid state electronic watch having an electronic module and battery cells for powering the module, said casing having a movement section accommodating said module and a power section receiving said cells, said casing having a back opening surrounded by a flange, the back being closed by two adjoining rectangular hatch pieces, one covering the movement section and the other the power section, the opposing ends of the hatch pieces having lips which fit under the flange, the adjoining ends of the hatch pieces having complementary grooves defining a split bore receiving a removable locking pin, the movement hatch piece carrying on its underside depressible contact springs which engage the poles of the cells seated in said power section whereby when the locking pin is withdrawn, the released springs cause the hatch piece to jump up to expose the power cells.

2. A casing as set forth in claim 1, wherein said rectangular casing has an arcuate cross-sectional formation to conform the casing to the wrist of the wearer, said hatch pieces having an arcuate formation.

3. A casing as set forth in claim 1, wherein said module is provided with a display unit at one end thereof, the unit being exposed to the viewer by a window formed in the corresponding end of said casing which is sloped.

4. A casing as set forth in claim 1, wherein said movement hatch piece has holes therein to receive screws for locking said piece to said casing.

5. A casing as set forth in claim 1 further including a panel of elastomeric material underlying said hatch pieces and waterproofing said sections.

* * * * *

UNITED STATES PATENT OFFICE

CERTIFICATE OF CORRECTION

PATENT NO. : 3,942,316

DATED : March 9, 1976

INVENTOR(S) : EGBERT VAN HAAFTEN

It is certified that error appears in the above-identified patent and that said Letters Patent are hereby corrected as shown below:

Column 4, line 26 "17 and 20" should have read -- 171 and 201 -- (l being the lower case of L and not the number 1)

Column 4, line 35 "top" should have read -- tip --

Signed and Sealed this eighteenth Day of May 1976

[SEAL]

*Attest:*

RUTH C. MASON
*Attesting Officer*

C. MARSHALL DANN
*Commissioner of Patents and Trademarks*